US012435955B2

(12) United States Patent
Petrovich Flynn

(10) Patent No.: US 12,435,955 B2
(45) Date of Patent: Oct. 7, 2025

(54) FLEXIBLE ARMOR

(71) Applicant: Naval Information Warfare Center Pacific, San Diego, CA (US)

(72) Inventor: Chandler J. Petrovich Flynn, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 246 days.

(21) Appl. No.: 18/503,764

(22) Filed: Nov. 7, 2023

(65) Prior Publication Data

US 2025/0146794 A1 May 8, 2025

(51) Int. Cl.
*F41H 5/04* (2006.01)

(52) U.S. Cl.
CPC ..... *F41H 5/04* (2013.01)

(58) Field of Classification Search
CPC ..... F41H 5/04
USPC ..... 89/36.05
See application file for complete search history.

(56) References Cited

U.S. PATENT DOCUMENTS 5,200,256 A * 4/1993 Dunbar ..... B32B 7/12 89/36.01
10,627,193 B1 * 4/2020 Meyers ..... F41H 5/0428
2009/0114083 A1 * 5/2009 Moore, III ..... F41H 5/0492 89/36.02
2012/0090452 A1 * 4/2012 Sudhakar ..... F41H 5/0457 70/237
2012/0174754 A1 * 7/2012 Salisbury ..... C04B 35/63456 89/917
2012/0312150 A1 * 12/2012 Gamache ..... F41H 5/0492 89/917
2020/0355472 A1 * 11/2020 Gamache ..... C04B 35/563

FOREIGN PATENT DOCUMENTS

CN 113899248 A * 1/2022 ..... F41H 5/04
WO WO-03089869 A2 * 10/2003 ..... F41H 5/0428

OTHER PUBLICATIONS https://www.thingiverse.com/thing:45203.

* cited by examiner

*Primary Examiner* — Samir Abdosh
(74) *Attorney, Agent, or Firm* — Naval Infomation Warfare Center Pacific; Kyle Eppele

(57) ABSTRACT

A flexible armor is described herein that includes a first and second layer of fiber weave material, an inner ceramic layer, and a sheer thickening fluid. The first layer of fiber weave material forms an outermost layer on one side of the flexible armor. The second layer of fiber weave material forms an outmost layer opposite the first layer of fiber weave material on the other side of the flexible armor. The inner ceramic layer is a single continuous piece of interlinked ceramic material that is formed in between the first layer of fiber weave material and the second layer of fiber weave material. The first layer of fiber weave material, the second layer of fiber weave material, the inner ceramic layer, or a combination thereof is coated in the shear thickening fluid and the shear thickening fluid fills open space within each layer.

20 Claims, 4 Drawing Sheets

FLEXIBLE ARMOR

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor. Licensing and technical inquiries may be directed to the Office of Research and Technical Applications, Naval Information Warfare Center Pacific, Code 72120, San Diego, CA, 92152; (619) 553-5118; NIWC_Pacific_T2@us.navy.mil. Reference Navy Case Number 113420.

BACKGROUND

Traditional armor for vehicles is typically composed of steel and other hard metals. The most commonly known body armor material made of fibers called Kevlar, which is still widely used. Another example of commonly used as body armor is Twaron. Both Kevlar and Twaron are synthetic fibers that can be used in body armor as well as other applications as protective armor. Other examples of body armor include rigid ceramic ballistic plates inserted into body armor and typically bonded to a fiber layer. Some examples include boron carbide, ultra-high-molecular weight polyethylene fiber, aramid, or fiberglass.

DESCRIPTION OF THE DRAWINGS

Features and advantages of examples of the present disclosure will be apparent by reference to the following detailed description and drawings, in which like reference numerals correspond to similar, but in some instances, not identical, components. Reference numerals or features having a previously described function may or may not be described in connection with other drawings in which they appear.

DETAILED DESCRIPTION

Ceramic properties are well known for the hardness-to-weight ratio. For this reason, ceramic armor has been investigated as a lightweight alternative to steel and other hard metals. Current ceramics used in armor are rigid, inflexible plates, commonly combined with synthetic fabrics, to form body armor used as protection. Current ceramic armor is rigid, inflexible, and heavy when combined with other material. As a result, using current ceramic armor, as body armor for example, limits mobility and flexibility due to the ceramic armors rigid and heavy nature.

In contrast, the flexible armor herein includes an inner ceramic layer that is formed as a single continuous piece of interlinked ceramic mesh. This results in a lighter, more flexible ceramic armor that provides more range of motion and mobility to the user when compared to traditional ceramic armor. Additionally, the size of the flexible armor is scalable as the ceramic armor is 3D printed. As a result, when the flexible armor is used as body armor, the flexible armor can be tailored to fit any individual. Furthermore, the flexible armor can also be used on any other objects that require ballistic protection, such as vehicles, due to the ability to scale the size.

A flexible armor is described herein that includes a first and second layer of fiber weave material, an inner ceramic layer, and a sheer thickening fluid. The first layer of fiber weave material forms an outermost layer on one side of the flexible armor. The second layer of fiber weave material forms an outmost layer opposite the first layer of fiber weave material on the other side of the flexible armor. The inner ceramic layer is a single continuous piece of interlinked ceramic material that is formed in between the first layer of fiber weave material and the second layer of fiber weave material. The first layer of fiber weave material, the second layer of fiber weave material, the inner ceramic layer, or a combination thereof is coated in the shear thickening fluid and the shear thickening fluid fills open space within each layer.

Figure 1:
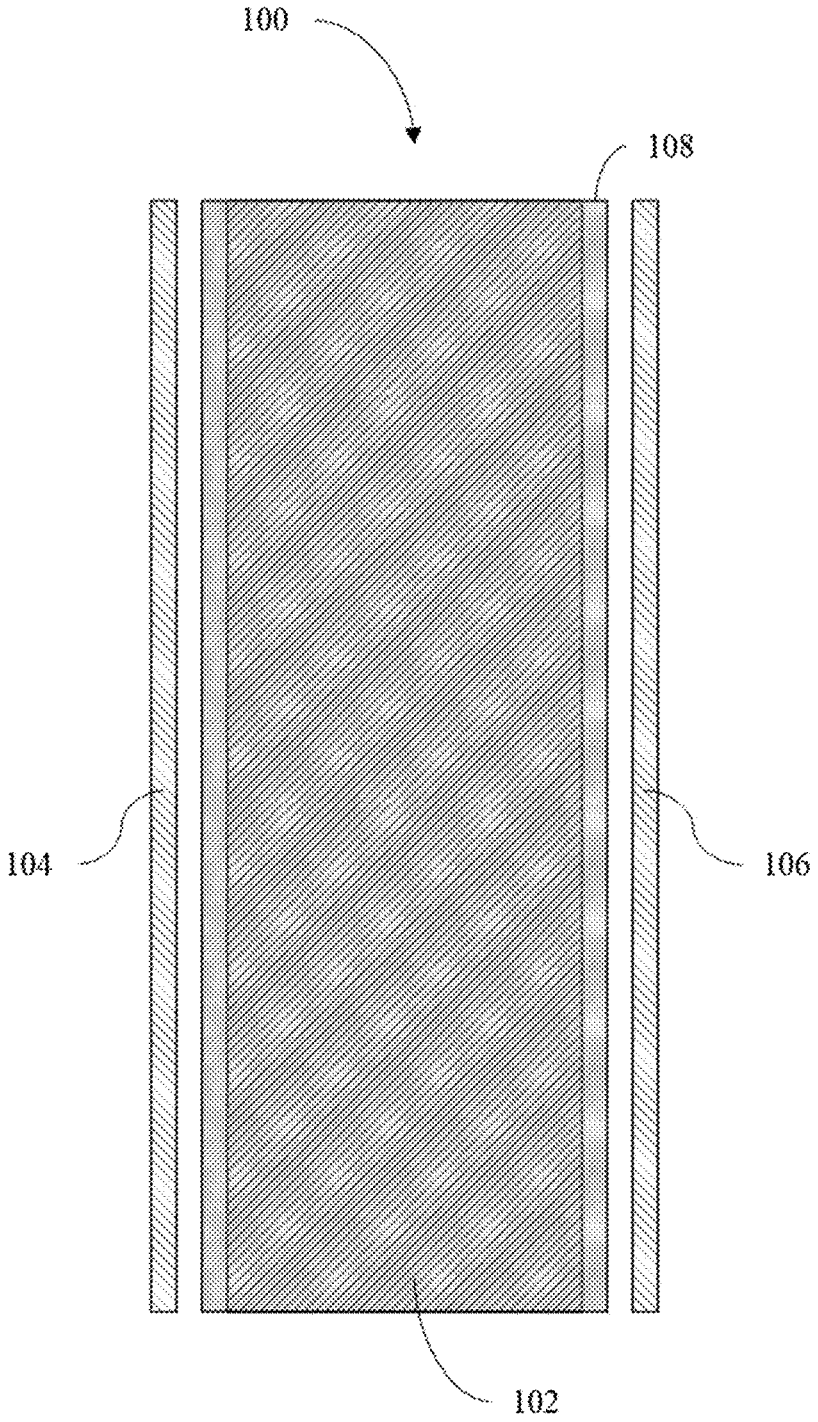
FIG. 1 is a cross-sectional view of an example of the flexible armor described herein with the inner ceramic layer suspended in a shear thickening fluid.

Referring now to FIG. 1, a cross-sectional view of an example of the flexible armor 100 is shown. In FIG. 1, the hatching pattern is for illustrative purposes only to aid in viewing and should not be construed as being limiting or directed to a particular material or materials. The flexible armor 100 includes a first layer of fiber weave material 104 and a second layer of fiber weave material 106. The first layer of fiber weave material 104 forms an outermost layer on one side of the flexible armor 100. The second layer of fiber weave material 106 forms an outmost layer opposite the first layer of fiber weave material 104 on the other side of the flexible armor 100 as shown in FIG. 1. In an example, the first layer of fiber weave material and the second layer of fiber weave material 104, 106 may be any type of ballistic fabric. In another example, the first layer of fiber weave material and the second layer of fiber weave material 104, 106 may be Kevlar, ballistic nylon, or a combination thereof.

Referring back to FIG. 1, the flexible armor 100 includes an inner ceramic layer 102. The inner ceramic layer 102 is a single continuous piece of interlinked ceramic material 200 that is in between the first layer of fiber weave material 104 and the second layer of fiber weave material 106. The inner ceramic layer 102 may be any type of ceramic material capable of being 3D printed. Some examples of the inner ceramic layer 102 include alumina, boron carbide, silicon carbide, and titanium diboride. The inner ceramic layer 102 may be any shape as long as the inner ceramic layer 102 is a single continuous piece of interlinked ceramic material 200. For example, the inner ceramic layer 102 may be in the shape of a garment, such as body armor, to be worn by an individual when combined with the first and second layer of fiber weave material 104, 106. In another example, the inner ceramic layer 102 may be in the shape of a blanket, to cover and protect equipment when combined with the first and second layer of fiber weave material 104, 106.

Figure 2:
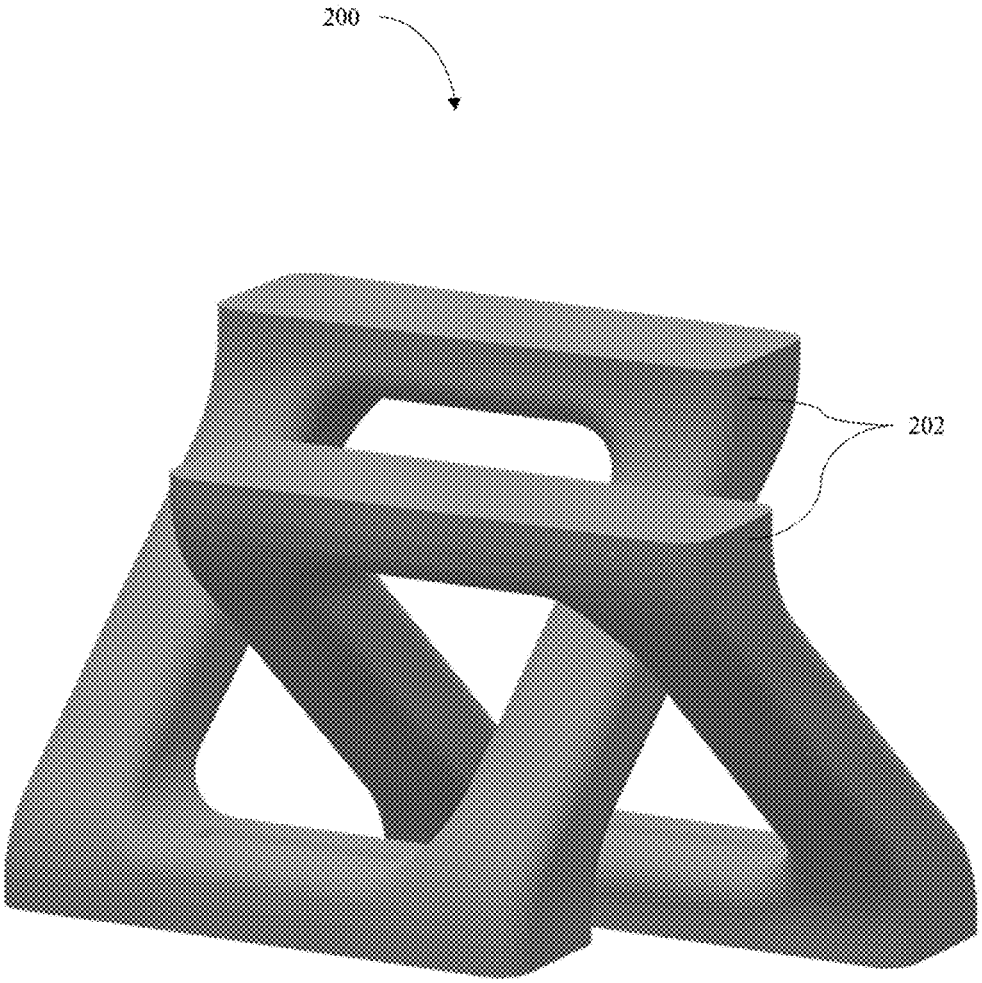
FIG. 2 is an example of the inner ceramic layer described herein that is used in the flexible armor.

An example of the individual pieces of interlinked ceramic material 202 that form the inner ceramic layer 102 are shown in FIG. 2. FIG. 2 shows two individual pieces of interlinked ceramic material 202 that are continuous pieces of ceramic material with no holes or gaps in the structure. Two or more individual pieces of interlinked ceramic material 202 may be linked together to any size depending on the application. For example, enough individual pieces of interlinked ceramic material 202 may be used to form a garment or a blanket as previously mentioned herein. The individual pieces of interlinked ceramic material 202 may be other shapes, such as circular interlinked pieces, triangular interlinked pieces, or any other shape that is capable of forming a single continuous piece of interlinked ceramic material 200.

Referring back to FIG. 1, the flexible armor 100 further includes a shear thickening fluid 108. In the example in FIG. 1, the inner ceramic layer 102 is coated in the shear thickening fluid 108 and the shear thickening fluid 108 fills open space within the inner ceramic layer 102. For example, if the inner ceramic layer is formed of individual pieces of interlinked ceramic material 202 as shown in FIG. 2, the shear thickening fluid 108 would fill the space within the square pieces. In an example, the shear thickening fluid 108 is a colloid, such as polyethylene glycol suspended in silica. The shear thickening fluid 108 may be present in an amount to completely coat the inner ceramic layer 102, which may vary depending on the size of the inner ceramic layer 102 and the application of the flexible armor 100.

Figure 3:
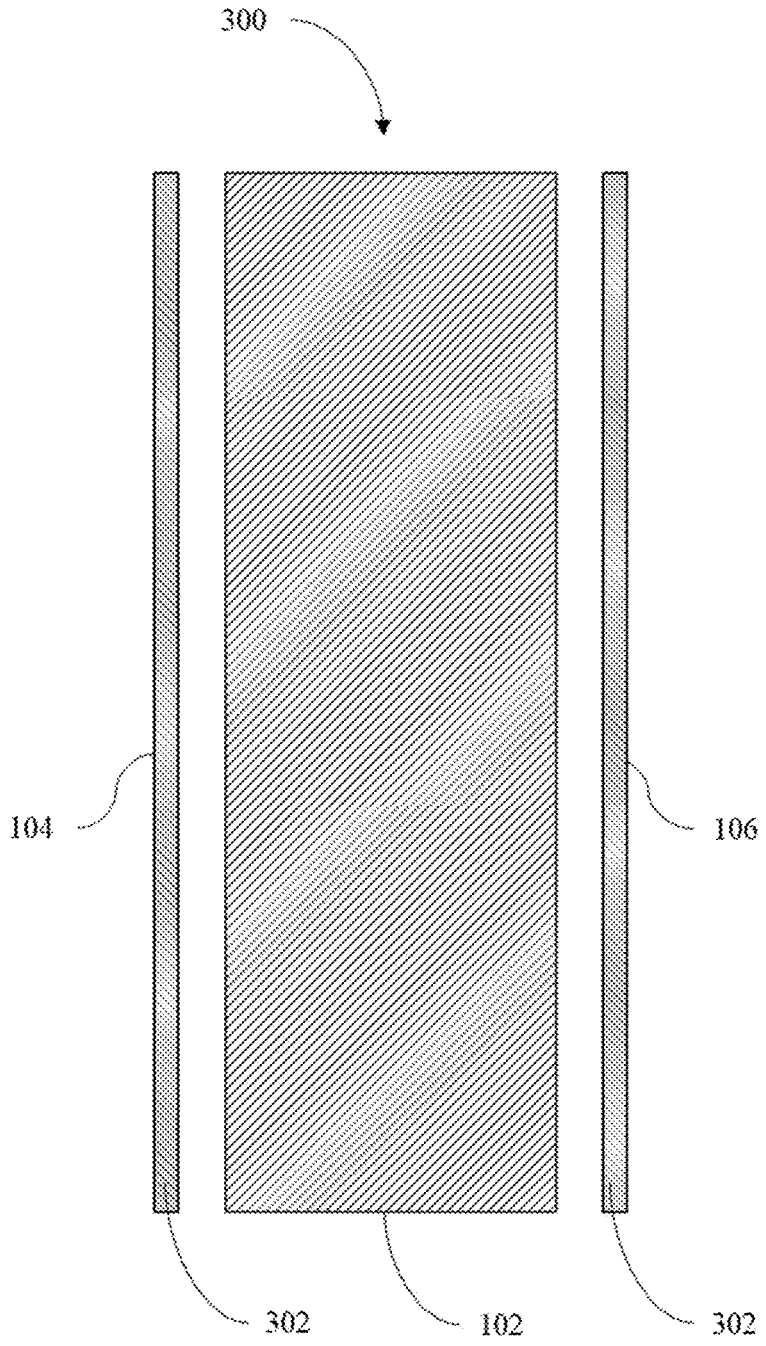
FIG. 3 is a cross-sectional view of another example of the flexible armor described herein with the first and second layer of fiber weave material coated in the shear thickening fluid.

Referring now to FIG. 3, a cross-sectional view of another example of the flexible armor 300 is shown. The flexible armor 300 shown in FIG. 3 has the same inner ceramic layer 102, first layer of fiber weave material 104, and second layer of fiber weave material 106 as previously disclosed herein. In the example shown in FIG. 3, the shear thickening fluid 108 is the same as previously disclosed herein, but the first and second layer of fiber weave material 104, 106 are coated in the shear thickening fluid 108. In other examples, the shear thickening fluid 108 may be coated onto the first layer of fiber weave material 104, the second layer of fiber weave material 106, the inner ceramic layer 102, or a combination thereof. The shear thickening fluid 108 may be present in an amount to completely coat the first layer of fiber weave material 104, second layer of fiber weave material 106, the inner ceramic layer 102, or a combination thereof, which may vary depending on the size of the first and second layer of fiber weave material 104, 106, the inner ceramic layer 102, and the flexible armor 300.

Figure 4:
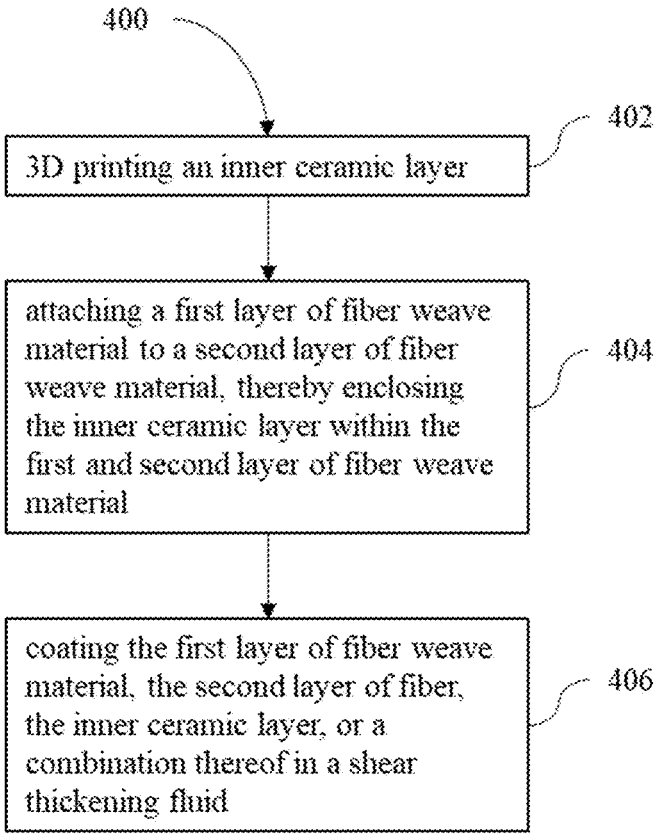
FIG. 4 is a method of making the flexible armor described herein with a sheer thickening fluid.

Referring now to FIG. 4, a method of making flexible armor 400 is shown. The method 400 includes 402 3D printing an inner ceramic layer where the inner ceramic layer is a single continuous piece of interlinked ceramic material. Any 3D printer may be used that is capable of printing with ceramic material. An example includes 3D printers that use resin-based technologies, such as stereolithography (SLA) or powder-based Binder Jetting. The 3D printed inner ceramic layer may be any ceramic material capable of being 3D printed. For example, the inner ceramic layer may be alumina, boron carbide, silicon carbide, and titanium diboride. The inner ceramic layer may be the same shape and size as previously disclosed herein.

Referring back to FIG. 4, the method 400 includes 404 attaching a first layer of fiber weave material to a second layer of fiber weave material, thereby enclosing the inner ceramic layer within the first and second layer of fiber weave material. The first and second layers of fiber weave material may be attached together using any known means, such as stitching. The first layer of fiber weave material forms an outermost layer on one side of the flexible armor and the second layer of fiber weave material forms an outmost layer opposite the first layer of fiber weave material on the other side of the flexible armor. The first and second layers of fiber weave material may be Kevlar, ballistic nylon, or a combination thereof. The first and second layers of fiber weave material may be the same size as previously disclosed herein.

Referring back to FIG. 4, the method 400 includes 406 coating the inner ceramic layer, the first layer of fiber weave material, the second layer of fiber weave material, or a combination thereof in a shear thickening fluid. The shear thickening fluid fills open space within the inner ceramic layer, the first layer of fiber weave material, or the second layer of fiber weave material, thereby forming the flexible armor. For example, if the inner ceramic layer is formed of individual pieces of interlinked ceramic material 202 as shown in FIG. 2, the shear thickening fluid would fill the space within the square pieces. In an example, the shear thickening fluid is a colloid, such as polyethylene glycol suspended in silica. The shear thickening fluid may be present in an amount to completely coat the inner ceramic layer, which may vary depending on the size of the inner ceramic layer and the application of the flexible armor 100.

In an example, the first layer of fiber weave material or the second layer of fiber weave material is coated in shear thickening fluid prior to attaching the first and second layer of fiber weave material together. In another example, the inner ceramic layer is coated in shear thickening fluid after attaching the first layer of fiber weave material and second layer of fiber weave material. However, an opening between the first layer of fiber weave material and second layer of fiber weave material is left to form a pouch with the inner ceramic layer therein. Prior to completing the attaching of the first layer of fiber weave material and second layer of fiber weave material, the shear thickening fluid is added to the pouch onto the inner ceramic layer. Once the shear thickening fluid has been added the first layer of fiber weave material and second layer of fiber weave material are completely attached together to form the flexible armor. The flexible armor formed may be garment, a blanket, or any other shape depending on the application.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of a list should be construed as a de facto equivalent of any other member of the same list merely based on their presentation in a common group without indications to the contrary.

Unless otherwise stated, any feature described herein can be combined with any aspect or any other feature described herein.

Reference throughout the specification to "one example", "another example", "an example", means that a particular element (e.g., feature, structure, and/or characteristic) described in connection with the example is included in at least one example described herein, and may or may not be present in other examples. In addition, the described elements for any example may be combined in any suitable manner in the various examples unless the context clearly dictates otherwise.

The ranges provided herein include the stated range and any value or sub-range within the stated range. For example, a range from about 0.1 to about 20 should be interpreted to include not only the explicitly recited limits of from about 0.1 to about 20, but also to include individual values, such as 3, 7, 13.5, etc., and sub-ranges, such as from about 5 to about 15, etc.

In describing and claiming the examples disclosed herein, the singular forms "a", "an", and "the" include plural referents unless the context clearly dictates otherwise.

What is claimed is:

1. A flexible armor, comprising a first layer of fiber weave material, wherein the first layer of fiber weave material forms an outermost layer on one side of the flexible armor;

a second layer of fiber weave material, wherein the second layer of fiber weave material forms an outmost layer opposite the first layer on the other side of the flexible armor;

an inner ceramic layer, wherein the inner ceramic layer is a single continuous piece of interlinked ceramic material that is in between the first layer of fiber weave material and the second layer of fiber weave material; and a shear thickening fluid, wherein the inner ceramic layer is coated in the shear thickening fluid and the shear thickening fluid fills open space within the inner ceramic layer.

2. The flexible armor of claim 1, wherein the first layer of fiber weave material and the second layer of fiber weave material are selected from a group consisting of Kevlar, ballistic nylon, or a combination thereof.

3. The flexible armor of claim 1, wherein the inner ceramic layer is selected from a group consisting of alumina, boron carbide, silicon carbide, and titanium diboride.

4. The flexible armor of claim 1, wherein the shear thickening fluid is a colloid.

5. The flexible armor of claim 1, wherein the flexible armor is a garment.

6. The flexible armor of claim 1, wherein the flexible armor is a blanket.

7. The flexible armor of claim 1, wherein the inner ceramic layer is any ceramic material capable of being 3D printed.

8. A flexible armor, comprising:

a first layer of fiber weave material, wherein the first layer of fiber weave material forms an outermost layer on one side of the flexible armor;

a second layer of fiber weave material, wherein the second layer of fiber weave material forms an outmost layer opposite the first layer on the other side of the flexible armor;

an inner ceramic layer, wherein the inner ceramic layer is a single continuous piece of interlinked ceramic material that is in between the first layer of fiber weave material and the second layer of fiber weave material; and a shear thickening fluid, wherein the shear thickening fluid is coated onto the first layer of fiber weave material, the second layer of fiber weave material, the inner ceramic layer, or a combination thereof.

9. The flexible armor of claim 8, wherein the first layer of fiber weave material and the second layer of fiber weave material are selected from a group consisting of Kevlar, ballistic nylon, or a combination thereof.

10. The flexible armor of claim 8, wherein the inner ceramic layer is selected from a group consisting of alumina, boron carbide, silicon carbide, and titanium diboride.

11. The flexible armor of claim 8, wherein the shear thickening fluid is a colloid.

12. The flexible armor of claim 8, wherein the flexible armor is a garment.

13. The flexible armor of claim 8, wherein the flexible armor is a blanket.

14. The flexible armor of claim 8, wherein the inner ceramic layer is any ceramic material capable of being 3D printed.

15. A method of making flexible armor, comprising:

3D printing an inner ceramic layer, wherein the inner ceramic layer is a single continuous piece of interlinked ceramic material;

attaching a first layer of fiber weave material to a second layer of fiber weave material, thereby enclosing the inner ceramic layer within the first and second layer of fiber weave material, wherein the first layer of fiber weave material forms an outermost layer on one side of the flexible armor and the second layer of fiber weave material forms an outmost layer opposite the first layer of fiber weave material on the other side of the flexible armor; and coating a first layer of fiber weave material, a second layer of fiber weave material, the inner ceramic layer, or a combination thereof in shear thickening fluid, wherein the first layer of fiber weave material or the second layer of fiber weave material is coated in shear thickening fluid prior to attaching and the inner ceramic layer is coated in shear thickening fluid after attaching by leaving an opening between the first layer of fiber weave material and second layer of fiber weave material to form a pouch with the inner ceramic layer therein prior to completing the attaching of the first layer of fiber weave material and second layer of fiber weave material and adding the shear thickening fluid to the pouch onto the inner ceramic layer and then completing the attaching the first layer of fiber weave material and second layer of fiber weave material together.

16. The method of claim 15, wherein the first layer of fiber weave material and the second layer of fiber weave material are selected from a group consisting of Kevlar, ballistic nylon, or a combination thereof.

17. The method of claim 15, wherein the inner ceramic layer is selected from a group consisting of alumina, boron carbide, silicon carbide, and titanium diboride.

18. The method of claim 15, wherein the shear thickening fluid is a colloid.

19. The method of claim 15, wherein the inner ceramic layer is any ceramic material capable of being 3D printed.

20. The method of claim 15, wherein the flexible armor forms a garment or a blanket.

* * * * *